United States Patent [19]

Hess

[11] 3,967,790

[45] July 6, 1976

[54] CARTRIDGE DRIVE APPARATUS

[75] Inventor: Ernst P. Hess, Castro Valley, Calif.

[73] Assignee: Qume Corporation, Hayward, Calif.

[22] Filed: Aug. 14, 1975

[21] Appl. No.: 604,758

Related U.S. Application Data

[63] Continuation of Ser. No. 448,848, March 7, 1974, abandoned.

[52] U.S. Cl. ..... 242/67.2; 197/151; 310/103; 242/75.5

[51] Int. Cl.[2] ..... B65H 17/04; B65H 17/18

[58] Field of Search ..... 242/67.2–67.5, 242/75.5, 201, 206, 207, 209, 68.3; 310/103; 197/151, 154, 168

[56] References Cited

UNITED STATES PATENTS

| | | | |
|---|---|---|---|
| 2,845,232 | 7/1958 | Johnson et al. | 242/67.2 |
| 3,301,091 | 1/1967 | Reese | 310/103 X |
| 3,502,279 | 3/1970 | Bundschuh et al. | 242/68.3 |
| 3,724,780 | 4/1973 | Wolf | 242/206 |
| 3,809,336 | 5/1974 | Kollar et al. | 242/75.5 X |

FOREIGN PATENTS OR APPLICATIONS

| | | | |
|---|---|---|---|
| 984,344 | 7/1951 | France | 310/103 |
| 972,139 | 1/1951 | France | |
| 612,320 | 11/1948 | United Kingdom | 310/103 |

*Primary Examiner*—Stanley N. Gilreath
*Assistant Examiner*—John M. Jillions
*Attorney, Agent, or Firm*—Townsend and Townsend

[57] ABSTRACT

Apparatus for driving a cartridge mounted rotatable ribbon capstan and take-up reel. A magnetic clutch assembly has a first gear driven by a motor for directly driving the capstan and a second gear magnetically driven by the first gear for driving the take-up reel through a gear train. The magnetic clutch assembly includes a magnetic drive ring secured to the first gear and having a plurality of inner peripheral teeth, a pair of annular magnetic members mechanically linked to the second gear, an annular magnet disposed between the magnetic members and a magnetic washer disposed below the lower magnetic member. The magnetic clutch assembly provides a yieldable driving force to the take-up reel which releases when the tension in the ribbon between the capstan and the take-up reel exceeds a predetermined threshold value. This threshold value may be adjusted by varying the dimension of the magnetic washer or the air gap between the drive ring and the annular magnetic members.

10 Claims, 5 Drawing Figures

CARTRIDGE DRIVE APPARATUS

This is a continuation of application Ser. No. 448,848, filed Mar. 7, 1974, now abandoned.

BACKGROUND OF THE INVENTION

This invention relates to apparatus for driving a capstan and take-up reel rotatably mounted in a cartridge.

Ribbon or tape cartridges normally employ a supply reel for holding a supply of fresh ribbon, a take-up reel about which the used ribbon is gathered and a capstan-pinch roller arrangement for providing a pulling force for withdrawing the ribbon from the supply reel transporting the ribbon at a constant rate past a work station, such as a print platen or the like, and retracting the ribbon back into the cartridge so that it may be accumulated on the take-up reel. In a fresh cartridge, the radius of the quantity of ribbon wrapped about the take-up reel is at a minimum. As the ribbon is payed out from the supply reel, translated past the work station, retracted into the cartridge and gathered about the take-up reel, the radius of the quantity of ribbon wrapped thereabout increases until the entire quantity of ribbon has been removed from the supply reel, after which the cartridge is discarded or the ribbon is rewound about the supply reel for re-use.

In cartridges of the above type, means must be provided for driving the take-up reel as well as the capstan, in order that the ribbon may be progressively accumulated on the take-up reel without snarling. Care must be taken, however, to ensure that the rate at which ribbon is gathered onto the take-up reel does not exceed the linear at which the ribbon is drawn into the cartridge by the capstan-pinch roller assembly. If this rate is exceeded, the take-up reel drive exerts a superior pulling force on the ribbon, which is highly undesirable in most applications. This criterion, however, is not easily met, since the rate at which the ribbon is gathered on the take-up reel is not uniform but increases as the radius of the reel plus accumulated ribbon. Efforts to date to design a simple, effective and economical cartridge drive mechanism which provides a constant rotational driving force to a cartridge capstan and a variable rotational driving force to a cartridge take-up reel have not met with wide success.

SUMMARY OF THE INVENTION

The invention comprises a drive mechanism for providing rotary motion for a take-up reel and a ribbon capstan from a single power source in such a manner that the amount of ribbon in the path between the capstan and the supply reel outer circumference is controlled to avoid slackening of the ribbon in this path and also to avoid excessive tension in the ribbon in this path. In the preferred embodiment, a stepping motor drives a first gear provided with a direct power take-off for providing a rotary driving force to a capstan. The first gear assembly includes a magnetic slip clutch for driving a take-up reel driving gear through an intermediate gear. The take-up reel driving gear includes a direct power take-off for providing a rotary driving force to the take-up reel.

The magnetic slip clutch includes a magnetic drive ring secured to the first gear and having a toothed inner periphery. A second gear having a central hollow hub is rotatably disposed about a central upstanding hub portion of the first gear and is provided with a toothed outer periphery in engagement with the intermediate gear. Secured to the second gear is a first annular magnetic member having a plurality of outer peripheral teeth corresponding to the inner peripheral teeth of the magnetic drive ring. Disposed below the first annular magnetic member are an annular magnet and a second annular magnetic member having a construction similar to the first magnetic ring, these latter elements being secured to the first annular magnetic member by the force provided by the magnet. Both annular magnet members are provided with an inwardly extending key engaged in a corresponding slot in the hub of the second gear in locking relationship therewith. The above arrangement provides an extremely low friction clutch drive having a slip threshold force permitting the second gear to slip relative to the first gear whenever a predetermined ribbon tension threshold is exceeded. An annular magnetic washer is positioned below the second magnetic ring for adjusting the clutch slip threshold value.

For a fuller understanding of the nature and advantages of the invention, reference should be had to the ensuing detailed description taken in conjunction with the accompanying drawings.

DESCRIPTION OF THE PREFERRED EMBODIMENT

Figure 1:
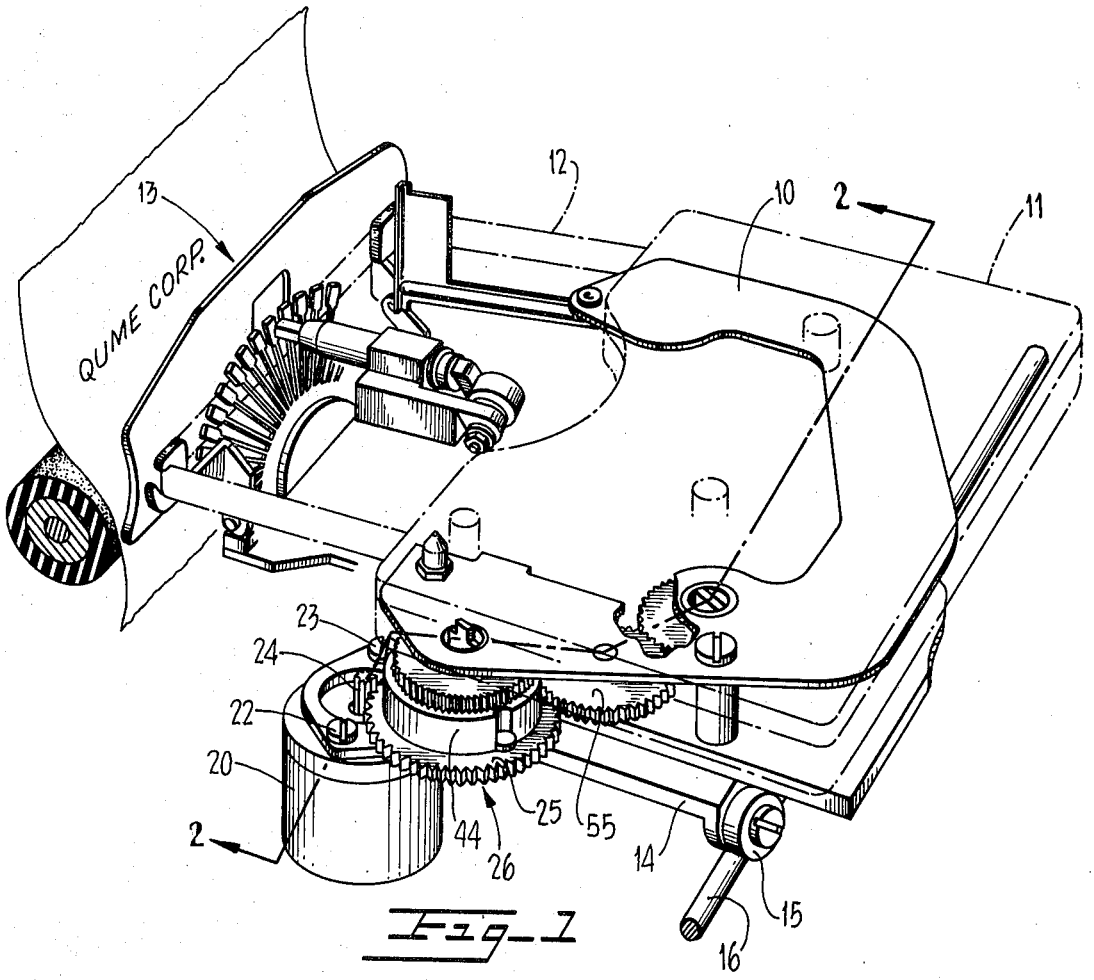
FIG. 1 is a perspective view of a preferred embodiment of the invention.

Turning now to the drawings, FIG. 1 illustrates the preferred embodiment of the invention designed for use with an inked ribbon cartridge of the type disclosed and claimed in co-pending patent application, Ser. No. 449,131 filed Mar. 7, 1974, "INK RIBBON CARTRIDGE WITH CONSTANT TENSION MECHANISM," filed concurrently herewith, the disclosure of which is hereby incorporated by reference. As seen in FIG. 1, a platform 10 provides a support for a cartridge 11 illustrated in phantom of the type disclosed in the above referenced co-pending patent application. The cartridge supplies an inked ribbon 12 to a print station generally indicated by reference numeral 13 and incorporates a supply reel, a capstan-pinch roller assembly for translating the inked ribbon past work station 13 and a take-up reel for gathering spent ribbon withdrawn into the cartridge by the capstan-pinch roller assembly. Platform 10 also provides support for the drive mechanism which is the subject of the instant application. Platform 10 includes a lower support plate 14 carrying a rotatable bearing member 15 which rides on the surface of a support shaft 16 so that the entire assembly may be translated in a direction parallel to the axis of shaft 16 by suitable drive means (not shown).

Figure 2:
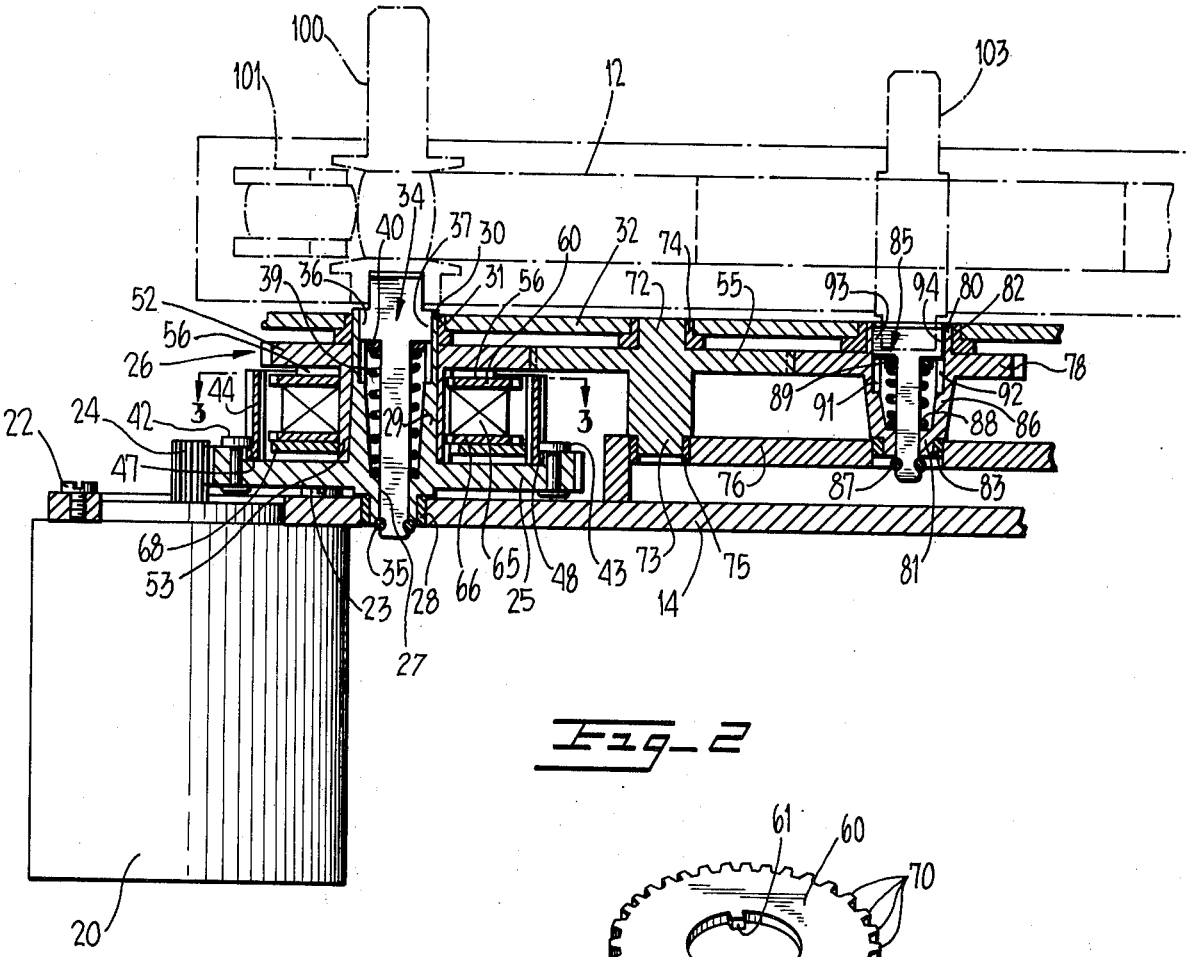
FIG. 2 is a sectional view of the FIG. 1 embodiment illustrating the drive train.

The drive mechanism includes a conventional stepping motor 20 which is secured to lower support plate 14 of platform 10 by means of a pair of cap screws 22, 23. Stepping motor 20 has a power output shaft 24 which is rotatably driven in incremental fashion. The teeth of shaft 24 are engaged with the outer teeth of a first gear 25 of a magnetic clutch assembly 26. As best shown in FIG. 2, first gear 25 has a substantially cylindrical lower portion 27 journaled in a bearing 28 secured in an aperture in lower support plate 14. Gear 25 also has a hollow central hub portion 29 with a slight inward taper in the upward direction and terminating in a substantially cylindrical portion 30 rotatably journaled in a bearing 31 secured to an upper support plate 32 of platform 10.

Reciprocably received within the hollow interior of gear 25 is a capstan drive key 34 which is secured by a clip 35 received in a pair of notches in the lower end of drive key 34. The interior of the upper portion 30 of gear 25 is provided with opposing slots for accomodating oppositely extending tab portions 36, 37 of drive key 34.

Drive key 34 is biased in the upward direction by means of a spring 39 which bears against the bottom wall of the central bore in gear 25 and against the lower surface of a bearing washer 40 slideably received on the lower stem portion of drive key 34.

Figure 3:
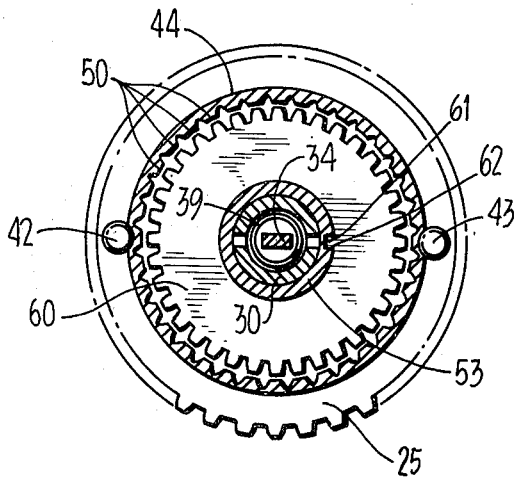
FIG. 3 is a sectional view taken along lines 3—3 of FIG. 2.
Figure 4:
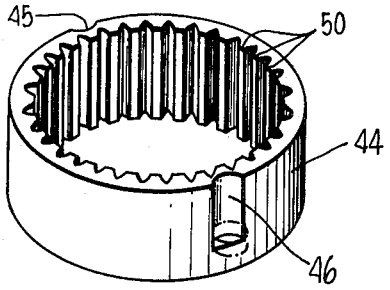
FIG. 4 is a perspective view of the magnetic drive ring.

Secured to gear 25 by means of a pair of rivets 42, 43 is a magnetic drive ring 44 having a pair of axially extending arcuate peripheral slots 45, 46 terminating in lands 47, 48 which are embraced by rivets 42, 43. As best seen in FIGS. 3 and 4, magnetic drive ring 44 has a toothed inner periphery with a plurality of tapered teeth 50 for a purpose to be described. Magnetic drive ring 44 may be fabricated from any suitable magnetic material.

Rotatably disposed about central hub portion 29 of gear 25 is a second gear 52 having a downwardly depending hollow hub portion 53 with an inner wall surface conformable with the outer wall surface of hub portion 29 of gear 25 and a toothed outer periphery engaged with the peripheral teeth of an intermediate gear 55. As shown in FIG. 2, gear 52 has a plurality of downwardly depending integrally formed rib portions 56 to the lower surface of which a first annular magnetic member 60 is secured by any suitable means, e.g., an adhesive.

Figure 5:
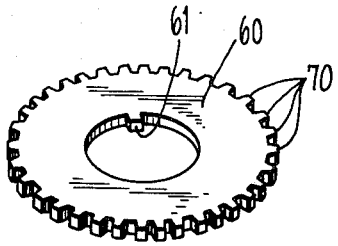
FIG. 5 is a perspective view of an annular magnetic member.

As best shown in FIGS. 3 and 5, annular magnetic member 60 has an inwardly projecting key 61 which is received in a corresponding key slot 62 in hub portion 53 of gear 52 to provide non-slip positive engagement therebetween. An annular magnet 65 and a second annular magnetic member 66 similar in construction to member 60 are mounted below ring 60. An additional washer 68 having an inner diameter substantially larger than the outer diameter of hub 53 to permit lateral movement of washer 68 thereon is mounted immediately below member 66. Magnet 65, member 66 and washer 68 are all fabricated from a suitable magnetic material and are held in place by the force of magnetic attraction provided by magnet 65.

With reference to FIGS. 3–5, members 60, 66 are each provided with a plurality of outer peripheral teeth 70 preferably corresponding in number to the plurality of inner peripheral teeth 50 of magnetic drive ring 44. The optimum number and the dimensions of teeth 50, 70 can vary with a given application and may be best determined on an empirical basis.

Teeth 50, 70 focus the magnetic flux generated by magnet 65 in order to provide magnetic coupling between gear 25 and gear 52. Depending on the physical dimensions of teeth 50, 70 and their geometrical configuration, this arrangement provides a driving force which yields whenever the force resisting rotation of gear 52 exceeds a predetermined threshold.

Intermediate gear 55 has a pair of oppositely extending integrally formed stud axles 72,73 rotatably journaled in a pair of bearings 74, 75 respectively secured in aligned apertures in upper plate 32 and an intermediate mounting plate 76. Intermediate gear 55 is enmeshed with a take-up reel drive gear 78 having upper and lower cylindrical end portions 80, 81 rotatably journaled in upper and lower bearing members 82, 83 press fitted into respective aligned apertures in upper plate 32 and intermediate plate 76. A take-up reel drive key 85 is reciprocably received in a hollow central hub portion 86 of gear 78. As shown in FIG. 2, drive key 85 is biased in the upward direction by means of a spring 88 and a bearing washer 89, and movement of drive key 85 in the upward direction is limited by a clip 87 received in a pair of notches in the lower end thereof. The hollow interior of hub portion 86 is provided with a pair of opposging slots for accomodating oppositely extending tab portions 91, 92 of drive key 85.

In operation, rotation of shaft 24 is directly transmitted to gear 25, which in turn directly drives capstan drive key 34 through tabs 36, 37. Rotation of gear 25 indirectly drives gear 52 via the magnetic force provided by magnetic drive ring 44, magnet 65 and annular magnetic members 60, 66. Rotation of gear 52 is transmitted via intermediate gear 55 to take-up reel drive gear 78, which directly drives take-up reel drive 85 through tabs 92, 91.

With reference to FIG. 2, rotation of capstan drive 34 is directly transmitted to an associated capstan 100 rotatably housed in ribbon cartridge 11 and shown in phantom, to cause rotation thereof. Rotation of capstan 100 and associated pinch roller 101 causes ribbon 12 to be fed into the interior of cartridge 11. Rotation of take-up reel drive key 85 is directly transmitted to a takeup reel 103 rotatably housed in cartridge 11 and shown in phantom. Rotation of take-up reel 103 causes the ribbon 12 fed into the interior of cartridge 11 to be accumulated about the circumference of the reel. The gear ratios of the various drive elements described above are selected so that the portion of ribbon 12 located in the region between the capstan 100 and the take-up reel 103, when empty, is maintained in a taut condition to prevent initial looping and possible snarling of ribbon 12 at the beginning of the reeling operation. As the quantity of ribbon 12 accumulated about take-up reel 103 increases during the reeling operation, the translational ribbon speed caused by the rotation of take-up reel 103 increases beyond the translational ribbon speed caused by rotation of capstan 100, generating a tensional force in ribbon 12 which increases with the speed differential. This tensional force is in the nature of a pulling force on capstan 100 which is transmitted to capstan drive key 34. When this pulling force exceeds the magnetic coupling force between gear 25 and gear 52, gear 25 slips relative to gear 52 until the ribbon tension drops below the threshold value. When this occurs, gear 52 is again rotated by gear 25, thereby driving take-up reel 103.

The magnitude of the threshold force is primarily dependent upon the strength of magnet 65, the magnetic permeability of drive ring 44, and annular magnetic members 60, 66, the number and dimensional configuration of teeth 50, 70 and the air gap therebetween. Once these parameters have been selected, however, the threshold force may be adjusted within varying limits by employing different magnetic washers 68 having different dimensional parameters. In practice, it has been found preferable to empirically establish these parameters for any given application.

As will now be apparent, the above described invention provides a simple, economical and reliable drive arrangement for a capstan and a take-up reel mounted in a cartridge, the drive arrangement providing a direct drive for the capstan and a releasable driving force for the take-up reel. Since the clutching action provided by the drive arrangement is magnetic, the clutch drive mechanism has an extremely long useful life. Further, the threshold adjustment provided by magnetic washer 68 enables the invention to be readily adapted to a wide variety of applications.

While the above provides a full and complete disclosure of the preferred embodiment, various modifications, alternate constructions, and equivalents may be employed without departing from the spirit and scope of the invention. For example, the incremental stepping motor 20 may be replaced by a continuous drive motor where a continuous capstan motion is desired. Therefore, the above should not be construed as limiting the invention, which is defined by the appended claims.

What is claimed is:

1. A compact apparatus for driving a cartridge mounted rotatable capstan and take-up reel to enable a ribbon to be transported by said capstan from a cartridge mounted supply reel and snugly accommodated on said take-up reel, said apparatus comprising:

a pair of spaced upper and lower support members;

a drive motor carried by one of said support members and having an output shaft provided with a driving gear;

a capstan drive assembly for providing a direct driving force to said capstan and a releasable driving force to said take-up reel, said capstan drive assembly including:

an input gear having an elongate central body portion rotatably secured at opposite ends thereof to said upper and said lower support members and a toothed periphery engaged with said motor driving gear, said central body portion having a central bore provided with a pair of oppositely disposed slotted walls axially extending from the end of said bore adjacent said upper support member toward the other end of said bore and terminating at an intermediate axial location, a capstan drive key received within said bore, said key having an upper end and a lower end and a pair of oppositely extending tab portions located at said upper end each slideably received by a different one of said slotted walls to permit axial translation of said key, rotation of said input gear being transmitted to said tab portions of said key by said slotted walls, means for biasing said key toward said upper support member, limit stop means secured to said key adjacent the lower end thereof for limiting axial translation of said key in the direction of said upper support member, an output gear having an elongate central body portion with a central bore slidably received on the outer surface of said central body portion of said input gear to permit relative rotation therebetween, said output gear having a toothed outer periphery located adjacent and below said upper support member, and a magnetic clutch assembly for providing a releasable driving force to said output gear from said input gear, said magnetic clutch assembly including a magnetic drive ring secured to said input gear and having a toothed inner peripheral surface, a pair of magnetic members mechanically linked to said central body portion of said output gear, each said magnetic member having a toothed outer peripheral surface positioned adjacent said inner peripheral surface of said magnetic drive ring, and a magnet positioned between said pair of magnetic members for providing magnetic flux linking said pair of magnetic members with said magnetic drive ring; and a reel drive assembly rotatably carried by said support members and driven by said output gear;

said magnetic clutch providing a releasable driving force for said output gear whenever the tension in the ribbon between said capstan and said reel lies below a predetermined threshold value.

2. The combination of claim 1 wherein said drive motor is carried by said lower support member.

3. The combination of claim 1 wherein said capstan drive key comprises a flat elongated member.

4. The apparatus of claim 1 further including an intermediate gear rotatably secured at opposite ends to said upper and lower support members and having a toothed periphery engaged with said toothed periphery of said output gear and said reel drive assembly.

5. The combination of claim 4 wherein said reel drive assembly includes a reel drive gear having an elongate central body portion rotatably secured at opposite ends to said upper and lower support members and a toothed periphery engaged with said toothed periphery of said intermediate gear, said central body portion of said reel drive gear having a central bore provided with a pair of oppositely disposed slotted walls axially extending from the end of said bore adjacent said upper support member toward the other end of said bore and terminating at an intermediate axial location, a reel drive key received within said reel drive gear bore, said key having an upper end, a lower end and a pair of oppositely extending tab portions each slidably received by a different one of said slotted walls to permit axial translation of said key, rotation of said reel drive gear being transmitted to said tab portions of said reel drive key by said slotted walls, means for biasing said reel drive key towards said upper support member, and limit stop means secured to said reel drive key adjacent the lower end thereof permitting axial translation of said key in the direction of said upper support member.

6. The apparatus of claim 1 wherein the number of outer peripheral teeth on at least one of said magnetic members is equal to the number of inner teeth on said magnetic drive ring.

7. The apparatus of claim 1 further including a magnetic washer positioned below the lower one of said pair of magnetic members for providing magnetic flux adjustment.

8. The apparatus of claim 1 wherein the upper one of said pair of magnetic members is secured to said output gear, and said magnet and the lower one of said magnetic pair of members are held in place by the magnetic force supplied by said magnet.

9. The apparatus of claim 1 wherein said drive motor comprises a stepping motor.

10. The apparatus of claim 1 wherein the outer surface of said central body portion of said output gear is provided with a keyway, and wherein each of said magnetic members is annular in shape with an inwardly directed key, said magnetic members being receiving on said hub portion with the keys positioned in said keyway.

* * * * *